US010803828B2

(12) United States Patent
Joshi et al.

(10) Patent No.: US 10,803,828 B2
(45) Date of Patent: Oct. 13, 2020

(54) LOCALLY ADAPTIVE BACKLIGHT CONTROL

(71) Applicant: Apple Inc., Cupertino, CA (US)

(72) Inventors: Ameya Joshi, Cupertino, CA (US); Marc Albrecht, Cupertino, CA (US); Sean Chang, Cupertino, CA (US); Tobias Jung, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 203 days.

(21) Appl. No.: 15/442,296

(22) Filed: Feb. 24, 2017

(65) Prior Publication Data

US 2018/0247609 A1 Aug. 30, 2018

(51) Int. Cl.
*G09G 5/10* (2006.01)
*G09G 3/34* (2006.01)

(52) U.S. Cl.
CPC ..... *G09G 5/10* (2013.01); *G09G 3/3426* (2013.01); *G09G 2320/0238* (2013.01); *G09G 2320/062* (2013.01); *G09G 2320/0606* (2013.01); *G09G 2320/0646* (2013.01); *G09G 2360/16* (2013.01)

(58) Field of Classification Search
CPC ..... G09G 3/2007; G09G 5/10; G09G 3/3406; G09G 3/3426; G09G 2320/0238; G09G 2320/0606; G09G 2360/16
See application file for complete search history.

(56) References Cited

U.S. PATENT DOCUMENTS

| | | | | |
|---|---|---|---|---|
| 8,736,543 | B2 * | 5/2014 | Kubota | G09G 3/3426 345/102 |
| 8,760,385 | B2 | 6/2014 | Kwon | |
| 8,896,638 | B2 | 11/2014 | Kurabayashi | |
| 9,142,157 | B2 | 9/2015 | Wurzel | |
| 2010/0194791 | A1 | 8/2010 | Ogi | |
| 2010/0259653 | A1 * | 10/2010 | Kimura | G09G 3/3406 348/252 |
| 2011/0316829 | A1 * | 12/2011 | Oka | G09G 3/3426 345/207 |
| 2012/0007896 | A1 * | 1/2012 | Kwon | G09G 3/3426 345/690 |
| 2014/0160181 | A1 * | 6/2014 | Takeda | G09G 3/2007 345/690 |
| 2014/0192078 | A1 * | 7/2014 | Gilbert | G09G 3/3406 345/590 |
| 2014/0285511 | A1 * | 9/2014 | Hoshino | G09G 5/10 345/590 |

(Continued)

*Primary Examiner* — Kent W Chang
*Assistant Examiner* — Sujit Shah
(74) *Attorney, Agent, or Firm* — Blank Rome LLP

(57) ABSTRACT

Systems, methods, and computer readable media to improve the operation of display systems are disclosed. In general, techniques are disclosed for dynamically adjusting backlight elements based on image content. More particularly, a backlight element's intensity may be targeted for boosting (i.e., increasing) based on content of the backlight element's corresponding image region, where after a check may be made to determine if the proposed increase is likely to risk generation of a halo. If the proposed intensity increase would risk a halo, the backlight element's proposed intensity may be dimmed. Repeating the boost/dim cycle in an iterative fashion permits an image to be displayed with brighter highlights and deeper blacks.

30 Claims, 8 Drawing Sheets
(6 of 8 Drawing Sheet(s) Filed in Color)

(56) References Cited

U.S. PATENT DOCUMENTS

| | | | | |
|---|---|---|---|---|
| 2015/0055025 | A1* | 2/2015 | Gotoh | G09G 3/3426 348/790 |
| 2015/0269895 | A1 | 9/2015 | Kao | |
| 2016/0117993 | A1* | 4/2016 | Buckley | G09G 3/3426 345/694 |
| 2016/0260390 | A1* | 9/2016 | Diao | G09G 3/3406 |
| 2016/0307523 | A1* | 10/2016 | Huang | G09G 3/3607 |
| 2018/0061330 | A1* | 3/2018 | Jeon | G09G 3/3688 |

* cited by examiner

LOCALLY ADAPTIVE BACKLIGHT CONTROL

BACKGROUND

Unlike cathode ray tubes (CRTs), liquid crystal displays (LCDs) do not produce light by themselves. They must be illuminated to produce a visible image. In LCDs this illumination source is referred to as a "backlight." Backlight illumination may come from the side (edge illumination) or from behind the LCD (backlight illumination). Edge-illuminated backlight systems use multiple light sources placed at the edges of a light-guide which distributes the light behind the LCD panel. Direct backlight systems use either a single light source (e.g., a electroluminescence panel or ELP) or multiple lighting elements placed directly behind the LCD panel. In some implementations, for example, a two-dimensional (2D) array of light emitting diodes (LEDs) may be placed behind the LCD panel.

SUMMARY

In one embodiment the disclosed concepts provide a method to dynamically control a display panel's backlight based on image content. The method includes obtaining an image having pixels (each pixel having a value); determining an initial brightness value for each of a plurality of backlight elements, where each backlight element is associated with a corresponding plurality of image pixels; determining a first proposed brightness value for each of the backlight elements, each first proposed brightness value based on a backlight element's initial brightness value and corresponding image pixel values; determining a second proposed brightness value for each of the backlight elements, each second proposed brightness value based on a backlight element's first proposed brightness value and a halo risk value; setting each backlight element's brightness value based the backlight element's second proposed brightness value; and displaying the image in conjunction with setting each backlight element's brightness value. In one or more embodiments, initial values may be predetermined (e.g., full-on, full-off, somewhere between full-on and full-off) or set to the brightness value a prior displayed frame/image (e.g., the immediately prior displayed frame). In other embodiments, determining first and second proposed brightness values may be repeated a specified number of times or until some criteria is met. In such embodiments, the second proposed brightness value of a first iteration may be used as an initial brightness value for the next iteration. In still other embodiments, the various methods may be embodied in computer executable program code and stored in a non-transitory storage device. In yet another embodiment, the method may be implemented in an electronic device having image display capabilities.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
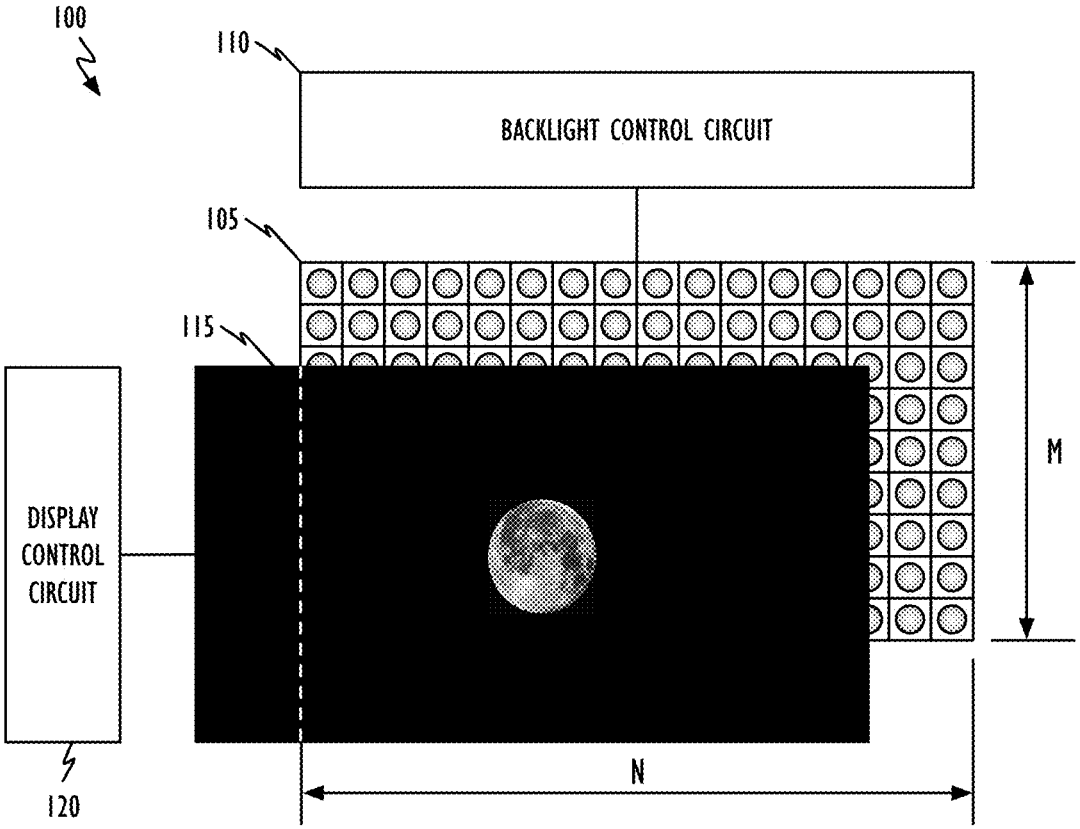
FIG. 1 shows, in block diagram form, a display system in accordance with one embodiment.

This disclosure pertains to systems, methods, and computer readable media to improve the operation of display systems. In general, techniques are disclosed for dynamically adjusting backlight elements based on image content. More particularly, a backlight element's intensity may be targeted for boosting (i.e., increasing) based on content of the backlight element's corresponding image region, where after a check may be made to determine if the proposed increase is likely to risk generation of a halo. If the proposed intensity increase would risk a halo, the backlight element's proposed intensity may be dimmed a bit. Repeating the boost/dim cycle in an iterative fashion permits an image to be displayed with brighter highlights and deeper blacks.

In the following description, for purposes of explanation, numerous specific details are set forth in order to provide a thorough understanding of the disclosed concepts. As part of this description, some of this disclosure's drawings represent structures and devices in block diagram form in order to avoid obscuring the novel aspects of the disclosed concepts. In the interest of clarity, not all features of an actual implementation may be described. Further, as part of this description, some of this disclosure's drawings may be provided in the form of flowcharts. The boxes in any particular flowchart may be presented in a particular order. It should be understood however that the particular sequence of any given flowchart is used only to exemplify one embodiment. In other embodiments, any of the various elements depicted in the flowchart may be deleted, or the illustrated sequence of operations may be performed in a different order, or even concurrently. In addition, other embodiments may include additional steps not depicted as part of the flowchart. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the disclosed subject matter, and multiple references to "one embodiment" or "an embodiment" should not be understood as necessarily all referring to the same embodiment.

Embodiments of a display system as set forth herein can assist with improving the functionality of computing devices or systems. Computer functionality can be improved by enabling such computing devices or systems to provide more faithful replication or display of high dynamic range (HDR) images. In addition, all images may be displayed with brighter highlights and deeper blacks than can conventional display systems. Use of a display system as disclosed herein can also reduce wasted computational resources. For example, because individual background elements may be dimmed independent of other background elements, system power may be reduced by dimming some backlight elements (when not needed for proper display) when other backlight elements need to be brighter for proper display.

It will be appreciated that in the development of any actual implementation (as in any software and/or hardware development project), numerous decisions must be made to achieve a developers' specific goals (e.g., compliance with system- and business-related constraints), and that these goals may vary from one implementation to another. It will also be appreciated that such development efforts might be complex and time-consuming, but would nevertheless be a routine undertaking for those of ordinary skill in the design and implementation of display systems having the benefit of this disclosure.

Referring to FIG. 1, in one or more embodiments adaptive backlight control system 100 includes an array or matrix of backlight elements 105, backlight control circuit 110, display element 115, and display control circuit 120. Array 105 may include, for example, light emitting diodes (LEDs), cold cathode fluorescent lamps (CCFLs) or electro-luminescent (EL) elements. While generally there may be any number of rows ('M') and columns ('N') of backlight elements, in one specific embodiment M=16 and N=9 (144 lighting elements). In another embodiment, backlight array 105 may include 576 elements (M=32 and N=18). Unlike prior art backlight control systems, circuit 110 may control the brightness of individual backlight elements within array 105 based on the frame (image) to be displayed. In some embodiments, this permits the display of brighter highlights and deeper blacks. More specifically, using adaptive local dimming techniques as described herein individual backlight elements may be dimmed while other backlight elements are not—thereby permitting improved local contrast. Prior art backlight systems, in contrast, generally adjust all backlight elements in concert and, in bright environments, typically adjust all backlight elements to maximum brightness. Display element 115 and display control circuit 120 may utilize conventional technology. For example, display element 115 may be a plasma display or a liquid crystal display (LCD). Illustrative types of LCDs include, but are not limited to, twisted nematic (TN), super twisted nematic (STN), film-compensated super twisted nematic (FSTN), color super twisted nematic (CSTN), double-layer super twisted nematic (DSTN), thin film transistor (TFT) and organic light-emitting diode (OLED) displays. It should be understood by those of ordinary skill in the art that display system 100 may include a number of other elements not shown in FIG. 1 such as polarizers and/or other filters (e.g., color filters), substrates (e.g., for electrical interface) and reflective surfaces (another type of substrate).

Figure 2:
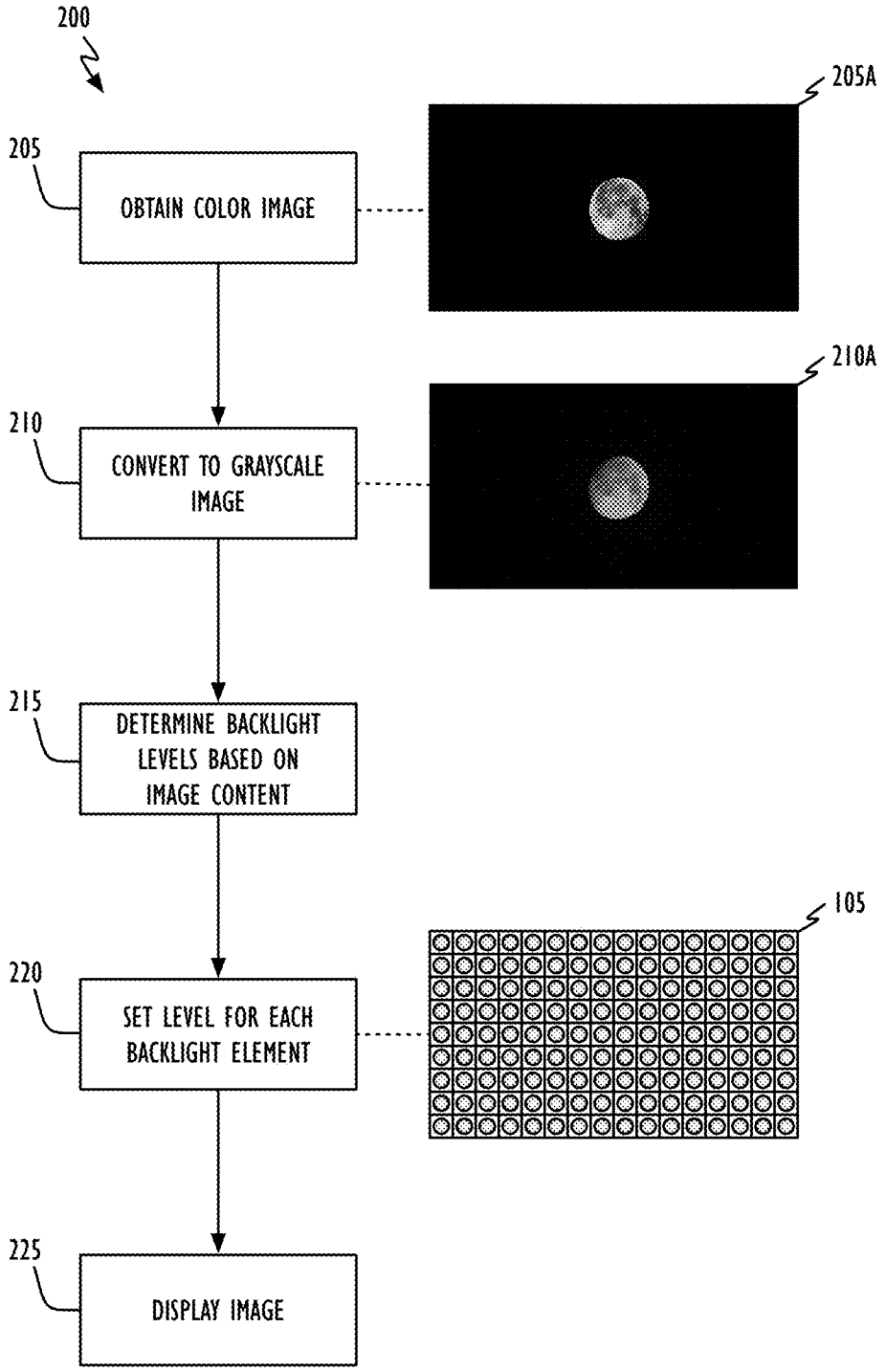
FIG. 2 shows, in flowchart form, an adaptive local backlight control operation in accordance with one or more embodiments.

Referring to FIG. 2, adaptive local backlight control operation 200 in accordance with one or more embodiments begins by obtaining a color frame for display (block 205); e.g., frame 205A. This image may be converted into a grayscale image (block 210); e.g., frame 210A. By way of example, each pixel in color image 205A may be converted to a corresponding pixel value in grayscale image 210A in accordance with one of the following formulas:

$$\text{grayscale_value}=\min(R,G,B),$$

$$\text{grayscale_value}=\max(R,G,B) \text{ or}$$

$$\text{grayscale_value}=\text{avg}(R,G,B).$$

Here, R, G and B represent the red, green and blue values of the pixel being converted, min( ) represents a function that returns the smaller of its arguments, max( ) represents a function that returns the larger of its arguments, and avg( ) represents a function that returns the average or mean of its arguments. Once converted, the grayscale image 210A may be used to determine the backlight levels for individual backlight elements (block 215), where after backlight elements 105 may be set (block 220) and image 205A displayed (block 225).

Figure 3:
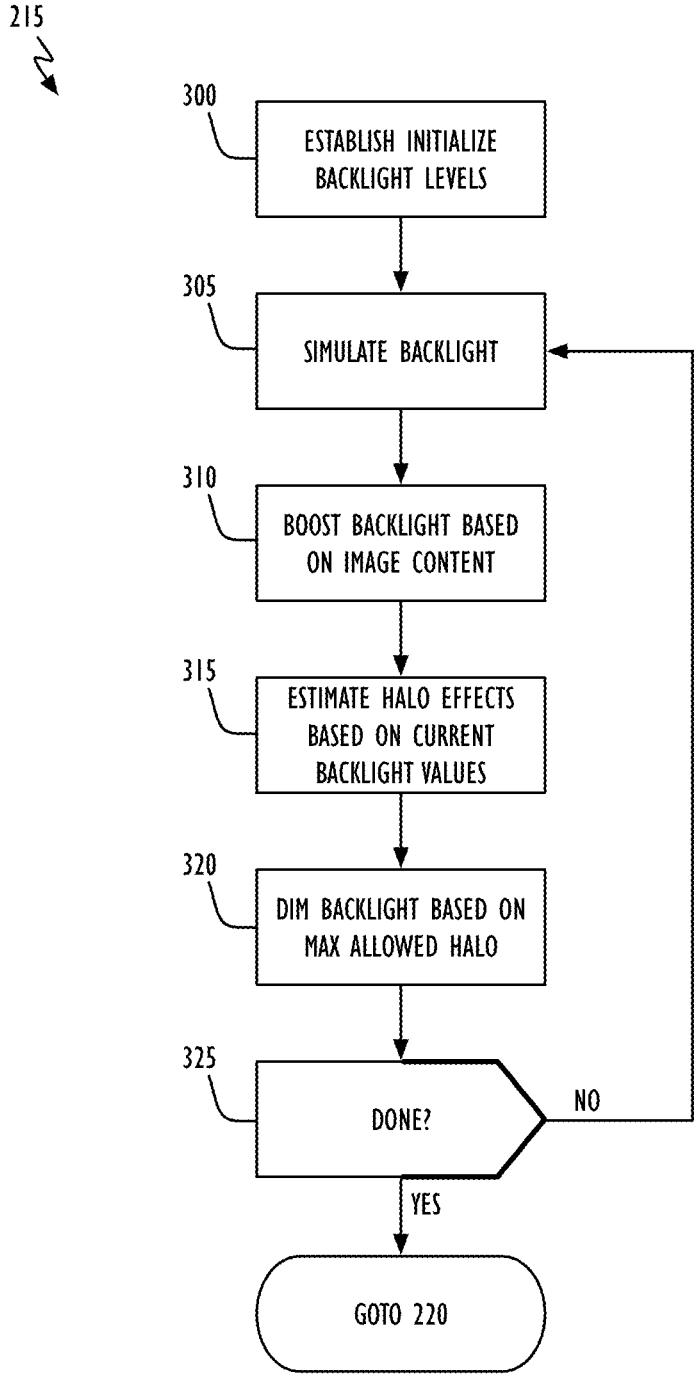
FIG. 3 shows, in flowchart form, another adaptive local backlight control operation in accordance with one or more embodiments.

Referring to FIG. 3, operation 215 of determining what level each backlight lighting element should be set to based on the content of the image to be displayed (e.g., image 205A) first establishes an initial proposed brightness level for each backlight element in backlight array 105 (block 300). In one embodiment, the initial proposed levels may be full-on. In another embodiment, the initial proposed levels may be full-off. In yet another embodiment, the initial proposed levels may be those levels finally determined for a prior image (e.g., the immediately prior image). In still another embodiment, the initial proposed levels may be somewhere between full-on and full-off (e.g., 50% of full-on).

Figure 4A:
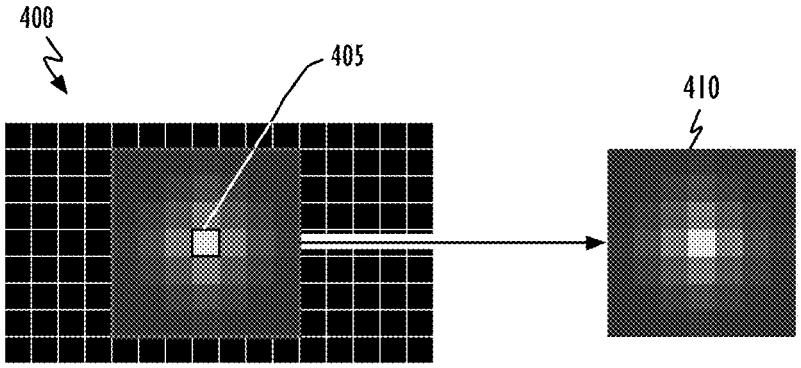
FIGS. 4A and 4B illustrate a backlight element's point-spread-function in accordance with some embodiments.
Figure 4B:
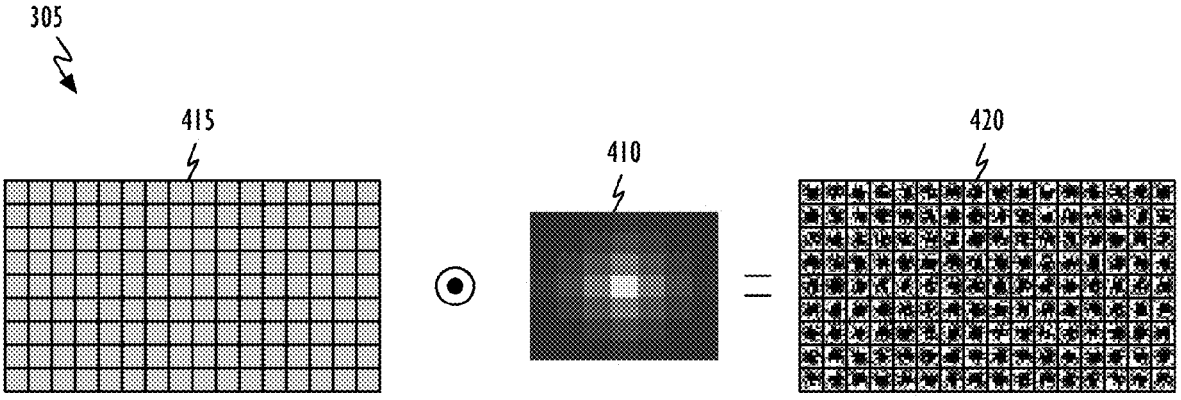

Before considering how all of the backlight elements interact to produce an overall backlight illumination (see block 305), consider how the light from a single backlight element may spread across backlight array 105. Referring to FIG. 4A wherein backlight array 400 has only a single backlight element 405 illuminated (full-on). The amount of light that "spills across" other backlight element regions is represented in color. In this example, yellow represents the maximum amount of light, falling to dark blue which represents very little light, falling to black which represents substantially no light (e.g., less than a specified amount of the maximum amount of light; for example, less than 1%). That region having more than the minimum specified amount of light such as region 410, may be referred to as the backlight element's point-spread-function or PSF. As shown, PSF 410 may be a subsampled region of the complete backlight array 400. Referring now to FIG. 4B, the convolution (represented by the '⊙' element) of the proposed initial backlight values 415 (determined in accordance with block 300) and PSF 410 can yield an estimate of the total backlight illumination 420.

Referring again to FIG. 3, once the spread of light from one backlight element to another backlight element has been accounted for (block 305), the proposed brightness for individual backlight elements within backlight array 105 may be boosted to account for the current image's content (block 310). In one embodiment, this may be done by determining the difference between a backlight element's current proposed intensity (as a result of actions in accordance with block 305) and the backlight intensity required by the image—referred to herein as an element's "backlight demand" or "$BL_{dmd}$." Backlight demand may be thought of as that amount of backlight needed to strike a balance between being too bright (and therefore leading to saturation) and too dim (and therefore sacrificing image content). The balance, of course, is a design decision that can depend upon the unique conditions of a specific implementation.

Figure 5:
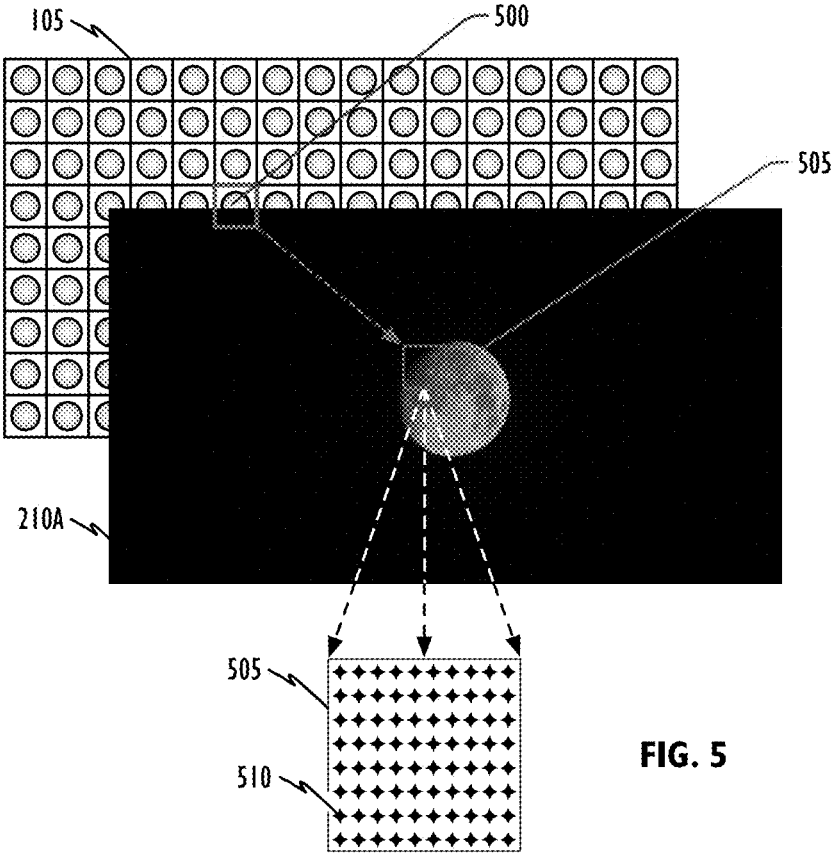
FIG. 5 illustrates the relationship between a backlight element (from a backlight array) and grayscale image in accordance with one embodiment.

Referring now to FIG. 5, the relationship between backlight element 500 in backlight array 105 and grayscale image 210A is shown. In particular, it can be seen that image region 505 (corresponding to backlight element 500) includes some number of pixels (e.g., pixel 510). The exact number of pixels will, of course, depend on the number of backlight elements and the number of pixels in image 210A.

In one specific embodiment, each backlight element may correspond to a region having 80×80 (6400 pixels) to 120×120 (14400 pixels). By way of example, if backlight array 105 has 144 elements (16×9) and image 210A has 8 Mega-pixels (3264×2448), then each backlight region corresponds to 55,488 pixels. If backlight image 210A has 5 Mega-pixels (2592×1944), then each backlight region corresponds to 34,992 pixels. Similarly, if backlight array 105 has 576 elements (32×18) and image 210A has 8 Mega-pixels (3264×2448), then each backlight region corresponds to 13,872 pixels. If backlight image 210A has 5 Mega-pixels (2592×1944), then each backlight region corresponds to 8,748 pixels. In some embodiments, backlight demand may be determined on a "per cell" basis where each cell includes those image pixels corresponding to a specific backlight element (e.g., region 505).

In one embodiment, a backlight element's backlight demand value may be set to the maximum value of any image pixel in its corresponding region. In another embodiment, a backlight element's backlight demand value may be set to the average value of the image pixels in its corresponding region. In yet another embodiment, a backlight element's backlight demand value may be set to some function of its corresponding region's pixels' maximum value, or minimum value, or average value or some combination thereof. In one particular embodiment, a backlight element's demand value may be determined as follows:

$$BL_{dmd}=\max(BL_{min},\alpha\times p_{mean}+(1-\alpha)p_{max}),\text{ where}$$

max( ) acts as described above, α represents some function of a backlight element's corresponding pixel values, $BL_{min}$ represents a minimum backlight value (chosen, for example, to make sure small and fine objects in the image remain visible), $p_{mean}$ represents the mean or average value of the backlight element's corresponding pixels, and $p_{max}$ represents the maximum value of the backlight element's corresponding pixels. In various embodiments, α may be some function of the backlight element's corresponding pixels' minimum, maximum, mean or median values. For example, $$\alpha=p_{mean}^{k},\text{ or}$$

$$\alpha=p_{mean}^{k}/k,\text{ or}$$

$$\alpha=p_{max}^{k},\text{ where}$$

"k" represents some constant that may be determined, for example, by performing front-of-screen tests. In one or more embodiments, $BL_{min}$ may be established in any manner desired. In some embodiments, $BL_{min}$ may be set as follows:

$$BL_{min}=k\times BL_{dmd},\text{ or}$$

$$BL_{min}=\frac{p_{min}}{p_{max}}\times BL_{dmd}.$$

In one embodiment, and based on front-of-the-screen tests to identify well displayed images and the above described approach to determining $BL_{dmd}$, k may be set to a value between 0.1 and 0.4.

Given each backlight element's currently determined proposed intensity (e.g., from block 305), and $BL_{dmd}$ and $BL_{min}$ values as determined above, the amount to boost a backlight element's proposed intensity in accordance with block 310 may be given as follows:

$$BL_{new}=f(BL_{cur},BL_{dmd},BL_{min},c),\text{ where}$$

$BL_{new}$ represents a new proposed intensity value for the backlight element (i.e., after being boosted in accordance with block 310), $BL_{cur}$ represents the backlight element's current proposed intensity value (e.g., as determined during block 305), $BL_{dmd}$ and $BL_{min}$ are as defined above, and "c" represents one or more constants that, in general, depend on the PSF of the backlight element. The precise nature of f( ) may be determined by the anticipated use of the target display system. In one illustrative embodiment, $BL_{new}$ for a given backlight element may be determined in accordance with the pseudo-code provided in Table 1.

TABLE 1

| Backlight Element Boost Determination |
|---|
| Let $BL_{dlta}=BL_{dmd}-BL_{cur}$;<br>IF $BL_{dlta}>0$, THEN<br>Let $X=\min\left(\max(0,1-BL_{cur}),\frac{f(BL_{dlta})}{c1}\right)$<br>and $BL_{new}=BL_{cur}+(X\times c2)$<br>ELSE<br>$BL_{new}=BL_{cur}$ |

Here, f( ) represents a function of $BL_{dlta}$, c1 is a constant that can be related to the backlight element's full-on value and c2 is another constant related to how aggressive the designer wishes to make the boost function embodied in block 310. The functional relationship $f(BL_{dlta})$ may incorporate any function found beneficial by the designer. By way of example, but not limitation, functional $f(BL_{dlta})$ may represent a power function (e.g., $x^y$ where y=−X . . . 0 . . . Y). While Table 1 describes how to boost a single backlight element, all of the backlight element's boosted values may be represented in matrix form as $[BL_{boost}]$; a (M×N) matrix in accordance with FIG. 1, wherein each element corresponds to a single backlight element.

Returning again to FIG. 3, the boost adjustment made to various backlight elements in accordance with block 310 (Table 1) may result in generating halo effects, especially in high contrast regions. As used herein, the term "halo" refers to visible light leakage from a backlight element in a black area of the image. These halo effects may be estimated (block 315) and the relevant backlight element's proposed values dimmed to reduce same (block 320). In one or more embodiments, the amount of halo generated by a backlight element (block 315) may be estimated as follows:

$$BL_{\Delta halo}=f(BL_{psf},BL_{risk}),\text{ where}$$

f( ) represents some function selected by the designer to meet their application's goal (e.g., a two-dimensional convolution), $BL_{psf}$ represents the backlight element's point-spread-function as described above, and $BL_{risk}$ represents the backlight element's risk of generating a halo based on the backlight element's corresponding proposed image pixel value.

Figure 6:
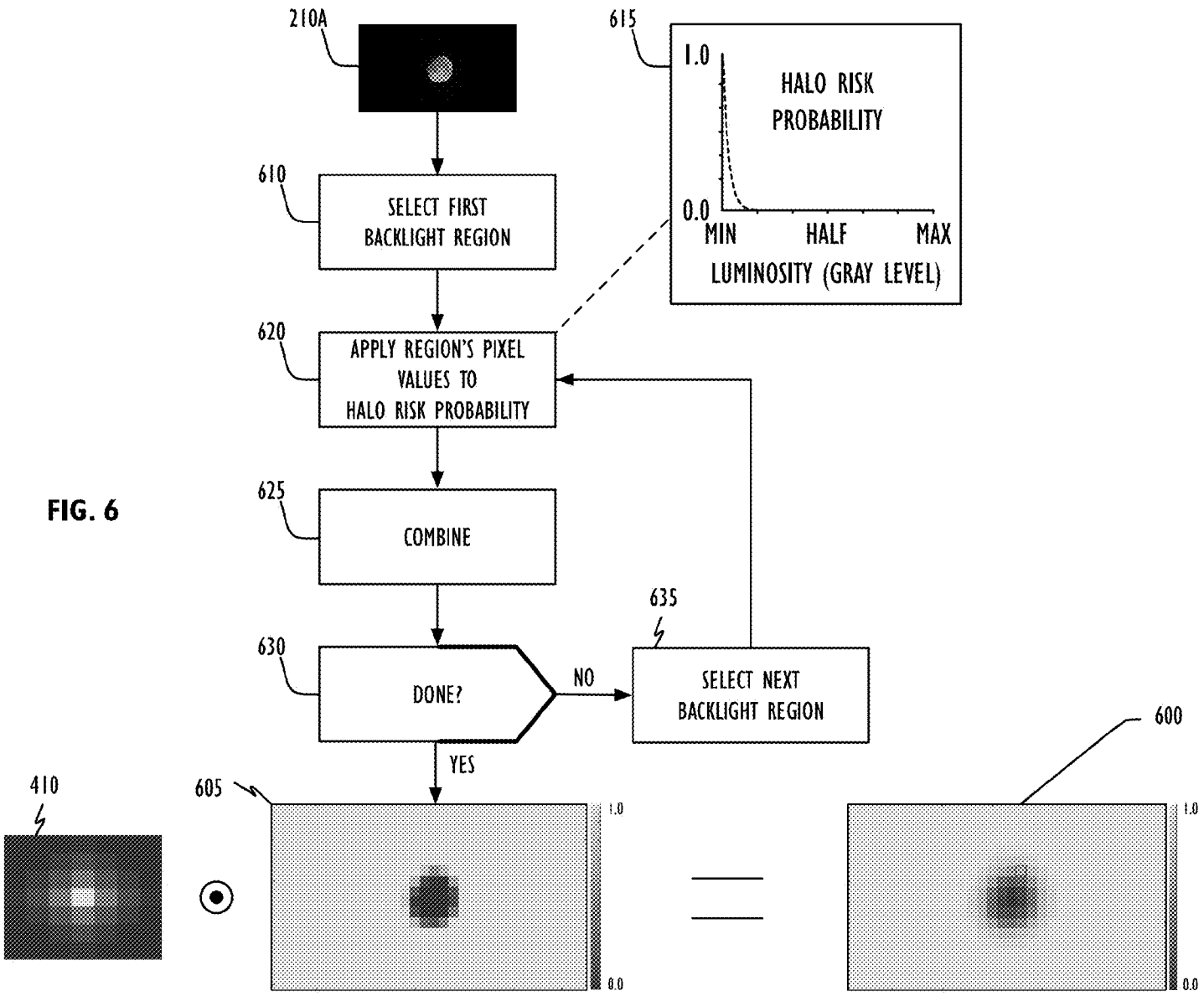
FIG. 6 shows, in block diagram and flowchart form, how to determine a change in halo risk in accordance with one or more embodiments.

Referring to FIG. 6, the change in halo risk or $BL_{\Delta halo}$ 600 may be determined by convolving (represented by the '⊙' operator) each backlight element's PSF 410 with the image's halo propensity 605. An image's halo propensity 605, in turn, may be determined by selecting a first backlight region from grayscale image 210A (block 610). As described in FIG. 5, each backlight element's corresponding region in image 210A includes a number of pixels, each of which has a value (e.g., intensity). Pixel values from the selected region may be applied to an empirically determined halo risk probability 615 (block 620), and the resulting values combined (block 625). In at least some embodiments halo risk probability 615 may be determined empirically and can be different from display system to display system. By way of example, if display element 115 is a LCD that has infinite contrast, even if a backlight element was full-on, there would be no risk of halo. Since no display element provides infinite contrast, there is some risk or probability that a given backlight intensity will generate a halo—that is what is represented in graph 615. In some embodiments, the act of combining (block 625) may include determining the average, or minimum, or maximum, or median of a backlight region's pixels' halo risk probabilities. For example, if there are 1600 pixels in a backlight region, acts in accordance with block 625 could determine the average of 1600 halo risk values, wherein each halo risk value is determined in accordance with graph 615. In another embodiment, acts in accordance with block 625 could determine the average of a backlight region's halo risk values after eliminating a specified first number (or percentage) of the dimmest pixels and a specified second number (or percentage) of the brightest pixels, wherein the first and second specified numbers or percentages do not have to be the same. In still another embodiment, acts in accordance with block 625 could find the average of 'N' halo risk values, wherein N corresponds to a specified number (or percentage) of a backlight region's brightest or dimmest pixels. In yet another embodiment, acts in accordance with block 625 may sort a backlight region's pixels (e.g., based on intensity) and select the median pixel and one or more pixels surrounding the median pixel; the mean of these pixels' halo risk probabilities may then be found. Once all of a backlight region's pixels have been evaluated, a check may be made to determine if all of the image's backlight regions have been processed (block 630). If at least one backlight region remains to be evaluated (the "NO" prong of block 630), the next backlight region may be selected (635) where after processing continues at block 620. If all backlight regions have been evaluated (the "YES" prong of block 630), the image's halo propensity 605 has been determined. Again using matrix notation, element 600 may be expressed in matrix form as $[BL_{\Delta halo}]$; a (M×N) matrix in accordance with FIG. 1, wherein each element corresponds to a single backlight element.

Returning yet again to FIG. 3, in one embodiment, the estimated halo effect in accordance with block 315 may be expressed, in matrix notation, as:

$$[BL_{halo}^{est}]=[BL_{boost}]\otimes[BL_{\Delta halo}], \text{ where}$$

$[BL_{boost}]$ and $[BL_{\Delta halo}]$ are as described above, and the '⊗' operator represents a pair-wise matrix multiplication. For M×N matrices A and B:

$$[A]\otimes[B]=\begin{bmatrix} a_{11}b_{11} & \dots & a_{1N}b_{1N} \\ \vdots & \ddots & \vdots \\ a_{M1}b_{M,1} & \dots & a_{MN}b_{MN} \end{bmatrix}.$$

In some embodiments, once the amount of halo, based on the current proposed backlight level and image content, has been estimated ($BL_{halo}^{est}$), it may be compared to a value indicative of the maximum allowed amount of halo in accordance with the pseudo-code in Table 2.

TABLE 2

| Backlight Element Dim Determination |
|---|
| Let $\Delta = BL_{halo}^{est} - BL_{halo}^{max}$;<br>IF $\Delta > 0$, THEN<br>  $BL_{dim} = \Delta$<br>ELSE<br>  $BL_{dim} = 0$ |

where $BL_{halo}^{max}$ represents the maximum amount of halo permitted as determined by front-of-screen tests, $BL_{dim}$ represents the value by which the backlight should be reduced in accordance with block 320, and $BL_{halo}^{est}$ is a selected value from the matrix $[BL_{halo}^{est}]$. In one embodiment, $BL_{halo}^{max}$ may be a constant. In another embodiment $BL_{halo}^{max}$ may be a constant determined in accordance with the current image (e.g., image 210A). In yet another embodiment, each element in $[BL_{halo}^{max}]$ may be a constant, but values may change from element to element.

With the backlight array's proposed values adjusted in accordance with block 320, a check may be made to determine if additional iterations through operation 215 need to be made (block 625). If additional iterations are desirable or needed (the "NO" prong of block 625), processing resumes at block 305 with the current proposed backlight levels or values taken as input (i.e., initial proposed backlight values). If no more iterations are to be performed (the "YES" prong of block 325), operation 215 moves to 220 (set backlight element in accordance with 215) and 225 (display image). In one embodiment, operations 305-320 may be performed a specified number of times (e.g., 1, 3, 5 or 8). In another embodiment operations 305-320 may be performed until a specified criteria is met (e.g., backlight element intensity convergence, processing time limit, etc.). In general, as the number of iterations increases so too does the visual quality of the displayed image. Increased iterations also take more processing time.

Figure 7:
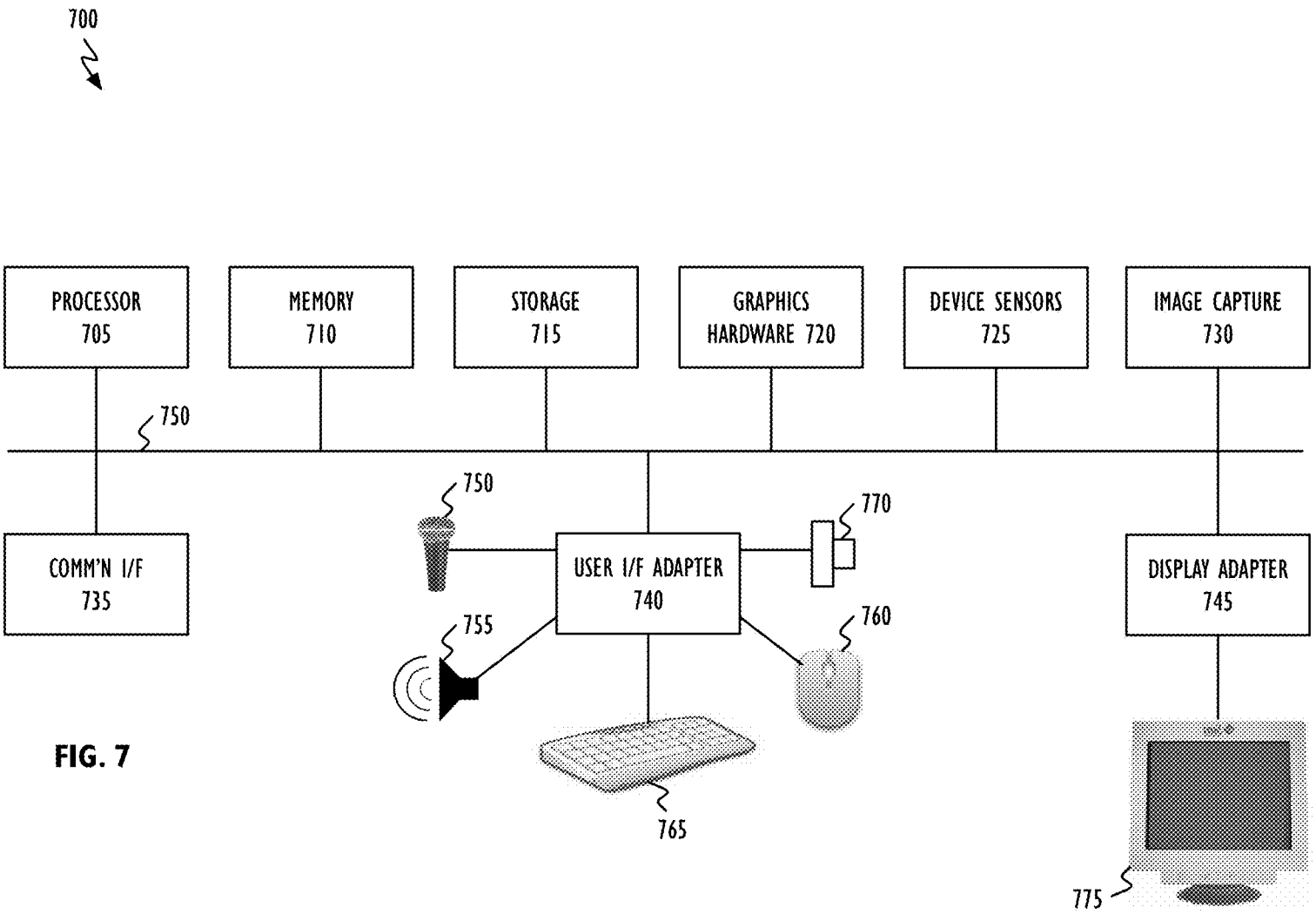
FIG. 7 shows, in block diagram form, a computer system in accordance with one embodiment.

Referring to FIG. 7, the disclosed backlight element adjustment operations in accordance with this disclosure may be performed by representative computer system 700 (e.g., a general purpose computer system such as a desktop, laptop, notebook or tablet computer system, or a gaming device). Computer system 700 can be housed in single computing device or spatially distributed between two or more different locations. Computer system 700 may include one or more processors 705, memory 710, one or more storage devices 715, graphics hardware 720, device sensors 725, image capture module 730, communication interface 735, user interface adapter 740 and display adapter 745—all of which may be coupled via system bus or backplane 750.

Processor module or circuit 705 may include one or more processing units each of which may include at least one central processing unit (CPU) and/or at least one graphics processing unit (GPU); each of which in turn may include one or more processing cores. Each processing unit may be based on reduced instruction-set computer (RISC) or complex instruction-set computer (CISC) architectures or any other suitable architecture. Processor module 705 may be a system-on-chip, an encapsulated collection of integrated circuits (ICs), or a collection of ICs affixed to one or more substrates. Memory 710 may include one or more different types of media (typically solid-state, but not necessarily so) used by processor 705, graphics hardware 720, device sensors 725, image capture module 730, communication interface 735, user interface adapter 740 and display adapter 745. For example, memory 710 may include memory cache, read-only memory (ROM), and/or random access memory (RAM). Storage 715 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Memory 710 and storage 715 may be used to retain media (e.g., audio, image and video files), preference information, device profile information, computer program instructions or code organized into one or more modules and written in any desired computer programming languages, and any other suitable data. When executed by processor(s) 705 and/or graphics hardware 720 and/or functional elements within image capture module 730 such computer program code may implement one or more of the methods described herein. Graphics hardware module or circuit 720 may be special purpose computational hardware for processing graphics and/or assisting processor 705 perform computational tasks. In one embodiment, graphics hardware 720 may include one or more GPUs, and/or one or more programmable GPUs and each such unit may include one or more processing cores. Device sensors 725 may include, but need not be limited to, an optical activity sensor, an optical sensor array, an accelerometer, a sound sensor, a barometric sensor, a proximity sensor, an ambient light sensor, a vibration sensor, a gyroscopic sensor, a compass, a barometer, a magnetometer, a thermistor sensor, an electrostatic sensor, a temperature sensor, a heat sensor, a thermometer, a light sensor, a differential light sensor, an opacity sensor, a scattering light sensor, a diffractional sensor, a refraction sensor, a reflection sensor, a polarization sensor, a phase sensor, a florescence sensor, a phosphorescence sensor, a pixel array, a micro pixel array, a rotation sensor, a velocity sensor, an inclinometer, a pyranometer and a momentum sensor. Image capture module or circuit 730 may include one or more image sensors, one or more lens assemblies, and any other known imaging component that enables image capture operations (still or video). In one embodiment, the one or more image sensors may include a charge-coupled device (CCD) or complementary metal oxide semiconductor (CMOS) sensor. Image capture module 730 may also include an image signal processing (ISP) pipeline that is implemented as specialized hardware, software, or a combination of both. The ISP pipeline may perform one or more operations on raw images (also known as raw image files) received from image sensors and can also provide processed image data to processor 705, memory 710, storage 715, graphics hardware 720, communication interface 735 and display adapter 745. Communication interface 735 may be used to connect computer system 700 to one or more networks. Illustrative networks include, but are not limited to, a local network such as a Universal Serial Bus (USB) network, an organization's local area network, and a wide area network such as the Internet. Communication interface 735 may use any suitable technology (e.g., wired or wireless) and protocol (e.g., Transmission Control Protocol (TCP), Internet Protocol (IP), User Datagram Protocol (UDP), Internet Control Message Protocol (ICMP), Hypertext Transfer Protocol (HTTP), Post Office Protocol (POP), File Transfer Protocol (FTP), and Internet Message Access Protocol (IMAP)). User interface adapter 740 may be used to connect microphone(s) 750, speaker(s) 755, pointer device(s) 760, keyboard 765 (or other input device such as a touch-sensitive element), and a separate image capture element 770—which may or may not avail itself of the functions provided by graphics hardware 720 or image capture module 730. Display adapter 745 may be used to connect one or more display units 775 which may also provide touch input capability. System bus or backplane 750 may be comprised of one or more continuous (as shown) or discontinuous communication links and be formed as a bus network, a communication network, or a fabric comprised of one or more switching devices. System bus or backplane 750 may be, at least partially, embodied in a network router or hub, a wireless access point (AP) or repeater, a set-top box, or a combination thereof.

Figure 8:
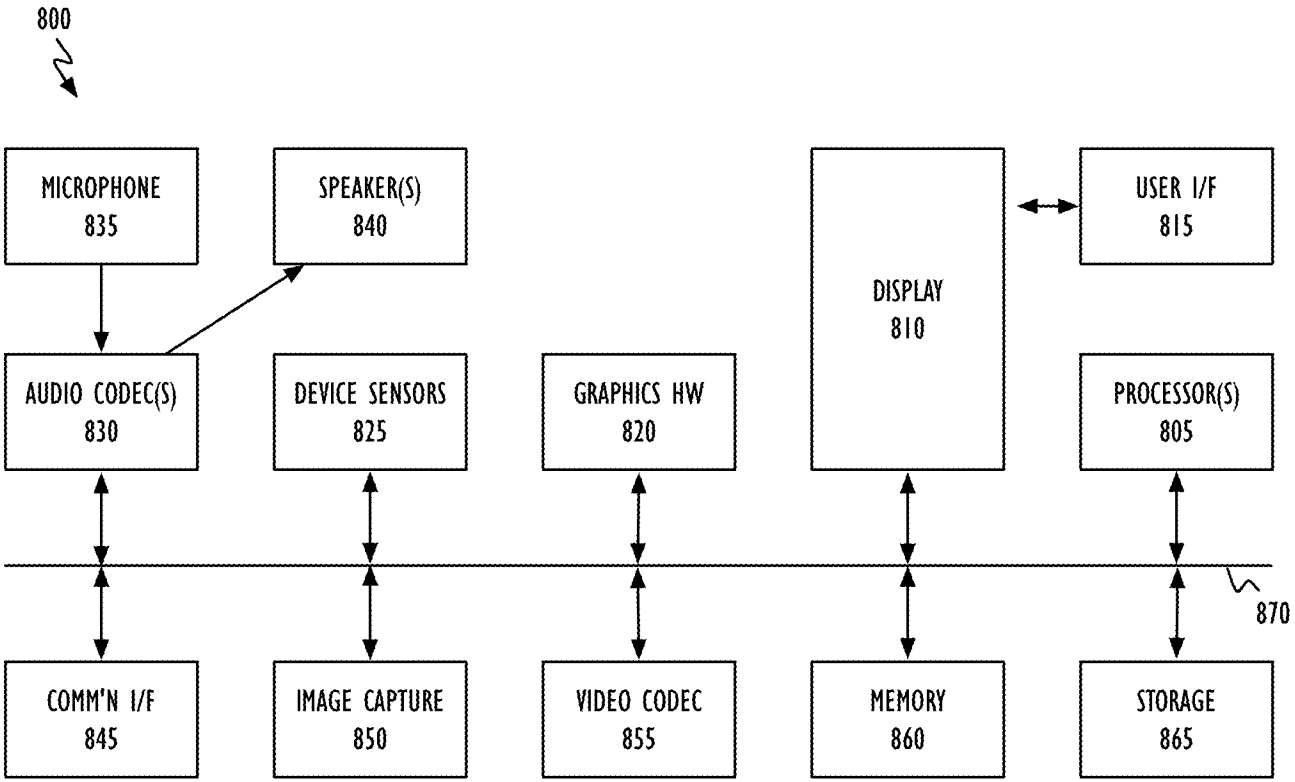
FIG. 8 shows, in block diagram form, a multi-function electronic device in accordance with one embodiment.

Referring to FIG. 8, a simplified functional block diagram of illustrative mobile electronic device 800 that is also capable of implementing the various backlight element adjustment operations as disclosed herein is shown. Electronic device 800 could be, for example, a mobile telephone, personal media device, a notebook computer system, or a tablet computer system. As shown, electronic device 800 may include processor module or circuit 805, display 810, user interface module or circuit 815, graphics hardware module or circuit 820, device sensors 825, microphone(s) 830, audio codec(s) 835, speaker(s) 840, communications module or circuit 845, image capture module or circuit 850, video codec(s) 855, memory 860, storage 865, and communications bus 870.

Processor 805, display 810, user interface 815, graphics hardware 820, device sensors 825, communications circuitry 845, image capture module or circuit 850, memory 860 and storage 865 may be of the same or similar type and serve the same function as the similarly named component described above with respect to FIG. 7. Audio signals obtained via microphone 830 may be, at least partially, processed by audio codec(s) 835. Data so captured may be stored in memory 860 and/or storage 865 and/or output through speakers 840. Output from image capture module or circuit 850 may be processed, at least in part, by video codec(s) 855 and/or processor 805 and/or graphics hardware 820. Images so captured may be stored in memory 860 and/or storage 865.

It is to be understood that the above description is intended to be illustrative, and not restrictive. The material has been presented to enable any person skilled in the art to make and use the disclosed subject matter as claimed and is provided in the context of particular embodiments, variations of which will be readily apparent to those skilled in the art (e.g., some of the disclosed embodiments may be used in combination with each other). For example, FIGS. 2, 3 and parts of 6 are flowcharts illustrating different aspects of the claimed subject matter; in one or more embodiments, one or more of the disclosed steps may be omitted, repeated, and/or performed in a different order than that described herein. Accordingly, the specific arrangement of steps or actions shown in FIGS. 2, 3 and 6 should not be construed as limiting the scope of the disclosed subject matter. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A display method, comprising:

obtaining an image, the image comprising pixels wherein each pixel has a value;

determining an initial brightness value for each of a plurality of backlight elements, wherein each of the backlight elements is associated with a corresponding plurality of image pixels;

determining a first proposed brightness value for each of the backlight elements, each first proposed brightness value based on a backlight element's initial brightness value and corresponding image pixel values;

determining a second proposed brightness value for each of the backlight elements, each second proposed brightness value based on:

determining a difference between a respective estimated halo effect value and a maximum amount of halo permitted threshold, wherein each estimated halo effect value is calculated using a respective backlight element's first proposed brightness value; and in response to a respective estimated halo effect value being greater than the maximum amount of halo permitted threshold, determining the second proposed brightness value by reducing a respective first proposed brightness value based on the difference, wherein each estimated halo effect value is calculated by multiplying each backlight element's first proposed brightness value by a respective change in halo risk value;

setting each backlight element's brightness value based on the backlight element's second proposed brightness value; and displaying the image in conjunction with setting each backlight element's brightness value.

2. The method of claim 1, wherein obtaining an image comprises:

obtaining a color image; and converting the color image to a grayscale image.

3. The method of claim 2, wherein determining an initial brightness value for each of a plurality of backlight elements comprises:

selecting a first initial brightness value for each of the backlight elements;

applying a point-spread-function to each backlight element's first initial brightness value to generate a first value; and determining the initial brightness value for each backlight element based on the backlight element's first value.

4. The method of claim 1, wherein determining a first proposed brightness value for each of the backlight elements comprises determining one or more statistical values for each backlight element, wherein each of a backlight element's one or more statistical values are based on the backlight element's corresponding image pixel values.

5. The method of claim 4, further comprising:

increasing the first proposed brightness value of a first backlight element based on the first backlight element's statistical values; and not adjusting the first proposed brightness value of a second backlight element based on the second backlight element's statistical values.

6. The method of claim 1, wherein determining a second proposed brightness value for each of the plurality of backlight elements comprises:

determining a halo risk value for each backlight element as a likelihood that a backlight element's first proposed brightness value would generate a halo effect when the image is displayed; and reducing the brightness of a backlight element based on the backlight element's halo likelihood.

7. The method of claim 1, further comprising:

determining, for each of the backlight elements, a second initial brightness value based on the second proposed brightness value; and repeating determining, for each of the backlight elements, first and second proposed brightness values based on the second initial brightness value.

8. The method of claim 7, wherein repeating is performed a specified number of times before each backlight element's brightness value is set, wherein each backlight element's brightness value is based on the last determined second proposed brightness value.

9. The display method of claim 1, wherein each change in halo risk value is a function of a backlight element's point spread function and a halo risk probability.

10. The display method of claim 1, wherein each first proposed brightness value is a boost value relative to each initial brightness value, wherein the second proposed brightness value is the same as the first proposed brightness value if the estimated halo effect value is less than or equal to the threshold, and wherein the second proposed brightness value is less than the first proposed brightness value if the estimated halo effect value is greater than the threshold.

11. A non-transitory programmable storage device having instructions configured to cause one or more processors to:

obtain an image, the image comprising pixels wherein each pixel has a value;

determine an initial brightness value for each of a plurality of backlight elements, wherein each of the backlight elements is associated with a corresponding plurality of image pixels;

determine a first proposed brightness value for each of the backlight elements, each first proposed brightness value based on a backlight element's initial brightness value and corresponding image pixel values;

determine a second proposed brightness value for each of the backlight elements, each second proposed brightness value based on:

determining a difference between a respective estimated halo effect value and a maximum amount of halo permitted threshold, wherein each estimated halo effect value is calculated using a respective backlight element's first proposed brightness value; and in response to a respective estimated halo effect value being greater than the maximum amount of halo permitted threshold, determine the second proposed brightness value by reducing a respective first proposed brightness value based on the difference, wherein each estimated halo effect value is calculated by multiplying each backlight element's first proposed brightness value by a respective change in halo risk value;

set each backlight element's brightness value based the backlight element's second proposed brightness value; and display the image in conjunction with setting each backlight element's brightness value.

12. The non-transitory programmable storage device of claim 11, wherein the instructions to obtain comprise instructions to:

obtain a color image; and convert the color image to a grayscale image.

13. The non-transitory programmable storage device of claim 12, wherein the instructions to determine an initial brightness value for each of a plurality of backlight elements comprise instructions to:

select a first initial brightness value for each of the backlight elements;

apply a point-spread-function to each backlight element's first initial brightness value to generate a first value; and determine the initial brightness value for each backlight element based on the backlight element's first value.

14. The non-transitory programmable storage device of claim 11, wherein the instructions to determine a first proposed brightness value for each of the backlight elements comprise instructions to determine one or more statistical values for each backlight element, wherein each of a backlight element's one or more statistical values are based on the backlight element's corresponding image pixel values.

15. The non-transitory programmable storage device of claim 14, further comprising instructions to:

increase the first proposed brightness value of a first backlight element based on the first backlight element's statistical values; and not adjust the first proposed brightness value of a second backlight element based on the second backlight element's statistical values.

16. The non-transitory programmable storage device of claim 11, wherein the instructions to determine a second proposed brightness value for each of the plurality of backlight elements comprise instructions to:

determine a halo risk value for each backlight element as a likelihood that a backlight element's first proposed brightness value would generate a halo effect when the image is displayed; and reduce the brightness of a backlight element based on the backlight element's halo likelihood.

17. The non-transitory programmable storage device of claim 11, further comprising instructions to:

determine, for each of the backlight elements, a second initial brightness value based on the second proposed brightness value; and repeat determining, for each of the backlight elements, first and second proposed brightness values based on the second initial brightness value.

18. The non-transitory programmable storage device of claim 17, wherein the instructions to repeat is performed a specified number of times before each backlight element's brightness value is set, wherein each backlight element's brightness value is based on the last determined second proposed brightness value.

19. The non-transitory programmable storage device of claim 12, wherein each change in halo risk value is a function of a backlight element's point spread function and a halo risk probability.

20. The non-transitory programmable storage device of claim 12, wherein each first proposed brightness value is a boost value relative each initial brightness value, wherein the second proposed brightness value is the same as the first proposed brightness value if the estimated halo effect value is less than or equal to the threshold, and wherein the second proposed brightness value is less than the first proposed brightness value if the estimated halo effect value is greater than the threshold.

21. An electronic system, comprising:

a memory;

a display having a plurality of backlight elements and operatively coupled to the memory; and one or more processors operatively coupled to the memory and display and configured to execute instructions stored in the memory to— obtain an image from the memory, the image comprising pixels wherein each pixel has a value;

determine an initial brightness value for each of a plurality of the display's backlight elements, wherein each of the backlight elements is associated with a corresponding plurality of image pixels;

determine a first proposed brightness value for each of the backlight elements, each first proposed brightness value based on a backlight element's initial brightness value and corresponding image pixel values;

determine a second proposed brightness value for each of the backlight elements, each second proposed brightness value based on:

determining a difference between a respective estimated halo effect value and a maximum amount of halo permitted threshold, wherein each estimated halo effect value is calculated using a respective backlight element's first proposed brightness value; and in response to a respective estimated halo effect value being greater than the maximum amount of halo permitted threshold, determine the second proposed brightness value by reducing a respective first proposed brightness value based on the difference, wherein each estimated halo effect value is calculated by multiplying each backlight element's first proposed brightness value by a respective change in halo risk value;

set each backlight element's brightness value based the backlight element's second proposed brightness value; and display, on the display, the image in conjunction with setting each backlight element's brightness value.

22. The electronic system of claim 21, wherein the instructions to obtain comprise instructions to:

obtain a color image; and convert the color image to a grayscale image.

23. The electronic system of claim 22, wherein the instructions to determine an initial brightness value for each of a plurality of backlight elements comprise instructions to:

select a first initial brightness value for each of the backlight elements;

apply a point-spread-function to each backlight element's first initial brightness value to generate a first value; and determine the initial brightness value for each backlight element based on the backlight element's first value.

24. The electronic system of claim 21, wherein the instructions to determine a first proposed brightness value for each of the backlight elements comprise instructions to determine one or more statistical values for each backlight element, wherein each of a backlight element's one or more statistical values are based on the backlight element's corresponding image pixel values.

25. The electronic system of claim 24, wherein the memory further comprises instructions to:

increase the first proposed brightness value of a first backlight element based on the first backlight element's statistical values; and not adjust the first proposed brightness value of a second backlight element based on the second backlight element's statistical values.

26. The electronic system of claim 21, wherein the instructions to determine a second proposed brightness value for each of the plurality of backlight elements comprise instructions to:

determine a halo risk value for each backlight element as a likelihood that a backlight element's first proposed brightness value would generate a halo effect when the image is displayed; and reduce the brightness of a backlight element based on the backlight element's halo likelihood.

27. The electronic system of claim 21, wherein the memory further comprises instructions to:

determine, for each of the backlight elements, a second initial brightness value based on the second proposed brightness value; and repeat determining, for each of the backlight elements, first and second proposed brightness values based on the second initial brightness value.

28. The electronic system of claim 27, wherein the instructions to repeat is performed a specified number of times before each backlight element's brightness value is set, wherein each backlight element's brightness value is based on the last determined second proposed brightness value.

29. The electronic system of claim 21, wherein each change in halo risk value is a function of a backlight element's point spread function and a halo risk probability.

30. The electronic system of claim 21, wherein each first proposed brightness value is a boost value relative each initial brightness value, wherein the second proposed brightness value is the same as the first proposed brightness value if the estimated halo effect value is less than or equal to the threshold, and wherein the second proposed brightness value is less than the first proposed brightness value if the estimated halo effect value is greater than the threshold.

* * * * *